US006302777B1

(12) United States Patent
Zoldan

(10) Patent No.: US 6,302,777 B1
(45) Date of Patent: Oct. 16, 2001

(54) COIN HOLDER

(75) Inventor: Romeo Zoldan, Edmonton (CA)

(73) Assignee: Unitylab Inc., Edmonton (CA)

( * ) Notice: Subject to any disclaimer, the term of this patent is extended or adjusted under 35 U.S.C. 154(b) by 0 days.

(21) Appl. No.: 09/579,505

(22) Filed: May 30, 2000

(51) Int. Cl.[7] ..... G07D 1/00; G07F 11/00

(52) U.S. Cl. ..... 453/54; 453/50; 453/51; 453/52; 453/53; 221/132; 221/91

(58) Field of Search ..... 453/50, 51, 52, 453/53, 54; 206/83, 84, 82; 221/132, 91

(56) References Cited

U.S. PATENT DOCUMENTS

| | | | | |
|---|---|---|---|---|
| 200,962 | * | 3/1878 | Amesbury | 453/54 |
| 601,259 | * | 3/1898 | Jones | 453/50 |
| 663,290 | * | 12/1900 | Miller | 453/54 |
| 1,030,092 | * | 6/1912 | Joseph | 453/54 |
| 1,158,552 | * | 11/1915 | Perry | 453/53 |
| 1,159,535 | * | 11/1915 | Schut | 453/54 |
| 1,163,173 | * | 12/1915 | Pusinelli | 453/54 |
| 1,193,203 | * | 8/1916 | Taliaferro | 453/54 |
| 1,309,991 | * | 7/1919 | Williams | 453/50 |
| 1,464,586 | * | 8/1923 | Reid | 453/50 |
| 1,486,621 | * | 3/1924 | Adler . | |
| 1,494,048 | * | 5/1924 | Wissotsky et al. | 453/54 |
| 2,553,257 | * | 5/1951 | Honeyman | 133/6 |
| 3,592,204 | * | 7/1971 | Hernandez | 133/6 |
| 3,731,695 | * | 5/1973 | Meijer | 453/54 |
| 3,743,085 | * | 7/1973 | Richert | 206/42 |
| 4,069,942 | * | 1/1978 | Marshall et al. | 221/4 |
| 4,117,952 | * | 10/1978 | Grimes | 221/5 |
| 4,128,188 | * | 12/1978 | White | 221/91 |
| 4,807,757 | * | 2/1989 | Rappaport et al. | 206/535 |
| 4,941,570 | * | 7/1990 | Kruger et al. | 206/267 |
| 5,026,321 | | 6/1991 | Benson . | |
| 5,267,893 | | 12/1993 | Mangigian . | |
| 5,397,017 | * | 3/1995 | Muza et al. | 221/91 |
| 5,492,504 | | 2/1996 | Wolters . | |
| 5,575,392 | * | 11/1996 | Cutler | 206/534 |
| 6,021,918 | * | 2/2000 | Dumont et al. | 221/2 |
| 6,068,158 | * | 5/2000 | Chabout | 221/113 |

FOREIGN PATENT DOCUMENTS

| | | | | |
|---|---|---|---|---|
| 80661 | | 5/1997 | (CA) . | |
| 000485819-A | * | 5/1992 | (EP) | 221/91 |
| 2692705-A1 | * | 12/1993 | (FR) | 453/54 |
| 1246100 | * | 9/1971 | (GB) | 453/54 |

* cited by examiner

*Primary Examiner*—Christopher P. Ellis
*Assistant Examiner*—Jeffrey A. Shapiro
(74) *Attorney, Agent, or Firm*—Bennett Jones LLP

(57) ABSTRACT

A coin holding apparatus includes a disk shaped casing and a locking ring. The casing defines three coin wells, each having upper and lower openings thereby having storage for six different coins in a compact casing. The locking ring rotates on the casing to open or close coin well openings to retain coins held within the casing or permit their removal.

12 Claims, 4 Drawing Sheets

COIN HOLDER

FIELD OF THE INVENTION

The present invention relates to pocket sized coin holders.

BACKGROUND OF THE INVENTION

Coin holders and dispensers are conventionally known in several forms. In one common form, as taught by U.S. Pat. No. 5,267,893 to Mangigan, issued Dec. 7, 1993, the dispenser has a crescent shaped ledge at the top of each chamber, opposite an ejection opening, to retain the coins. Each chamber contains a plate-like follower over a compression spring which urges a stack of coins upwards against the ledge. The follower and the stack of coins will easily tilt when pressured by a user's finger. A portion of the topmost coin is exposed and may be slid out by the user.

In one prior art device, described in U.S. Pat. No. 5,026,321 to Benson, issued Jun. 25, 1991, the chamber also includes a lip which retains the topmost coin from sliding out. The coin stack must be tilted such that the outer edge of the topmost coin passes over the lip, at which point the coin may be slid out from the chamber.

These and other prior art devices compromise their design as a result of two conflicting design goals: the coin holder must securely retain the coins and prevent unintentional ejection while allowing easy and convenient removal of coins when desired. Therefore, there is a need in the art for an improved coin holder which achieves both goals of security and convenience.

Also, lower denomination bills are being replaced by coins in many countries. Canada now issues one and two dollar coins and as result has six different coins in mass circulation. In order of increasing size, they are the 10 cent piece, the penny, the 5 cent piece, the 25 cent piece, the dollar coin and the two dollar coin. As well, the United States will soon be using a one dollar coin in place of the one dollar bill. Therefore, there is a need in the art for a coin holder which is compact enough to comfortably carry in a pocket or purse while being able to carry many different coin sizes securely.

SUMMARY OF THE INVENTION

The present invention is directed to a coin holder. In one aspect of the invention, the invention comprises a coin holding apparatus comprising:

(a) a disk shaped casing comprising an upper wall, a lower wall and a peripheral wall, wherein said casing defines at least one internal coin well for receiving a substantially circular coin of a certain diameter and thickness, said coin well having an opening which:

i. opens through a gap in the peripheral wall wherein the width of said gap is larger than the diameter of the coin and the height of said gap is larger than the thickness of the coin; and ii. opens through the upper wall such that an outer portion of the coin well is open through the opening and an inner portion of the coin well is covered by the casing;

(b) a band which encircles and rotationally engages the casing peripheral wall and which comprises at least one projection along a portion of the band wherein said band is rotatable between a closed position where the at least one projection blocks the peripheral surface gap of the at least one opening thereby blocking lateral removal of a coin from the coin well and an open position where the at least one projection does not block the peripheral surface gap; and (c) a retaining disk which is positioned within the at least one coin well and which is moveable vertically within the coin well; and (d) biasing means for urging the disk towards the upper wall of the casing.

In one embodiment, the coin well has two coin openings wherein the first opening opens through the upper wall and the second opening opens through the lower wall and the apparatus further comprises a second retaining disk which is positioned within the at least one coin well and which is moveable vertically within the coin well and biasing means for urging the first disk towards the upper surface and the second disk towards the lower surface. Preferably, there are at least two, and preferably three, coin wells of different sizes to accommodate coins of different diameters, where each coin well has a first and second opening.

In one embodiment, the casing comprises an upper wall casing half and a lower wall casing half which mate together. In a preferred embodiment, the two casing halves are bonded together. More preferably, the two casing halves are held together by at least one pair of interlocking pins, one of which is inserted through the upper casing wall and one of which is inserted through the lower casing wall.

In another aspect of the invention, the invention comprises a coin holding apparatus comprising:

(a) a circular casing having a top side and a bottom side and internal walls defining three coin wells, each coin well having a first opening through the top side and a second opening through the bottom side, wherein each opening is sized to permit a coin to be slid into and out of the coin well laterally but not vertically;

(b) a first disc and a second disc each disposed in each coin well and each moveable vertically within each coin well;

(c) biasing means for spreading each first and second disc pair apart within each coin well;

(d) a band which rotationally engages the circumference of the casing, wherein said band defines six projections, each projection corresponding to an opening, and wherein said band is moveable between a closed position where each projection blocks its corresponding opening to prevent lateral movement of a coin positioned within the coin well and an open position where the projection does not block its corresponding opening.

BRIEF DESCRIPTION OF THE DRAWINGS

The invention will now be described by way of an exemplary embodiment with reference to the accompanying simplified, diagrammatic, not-to-scale drawings. In the drawings.

DETAILED DESCRIPTION OF THE INVENTION

Figure 1:
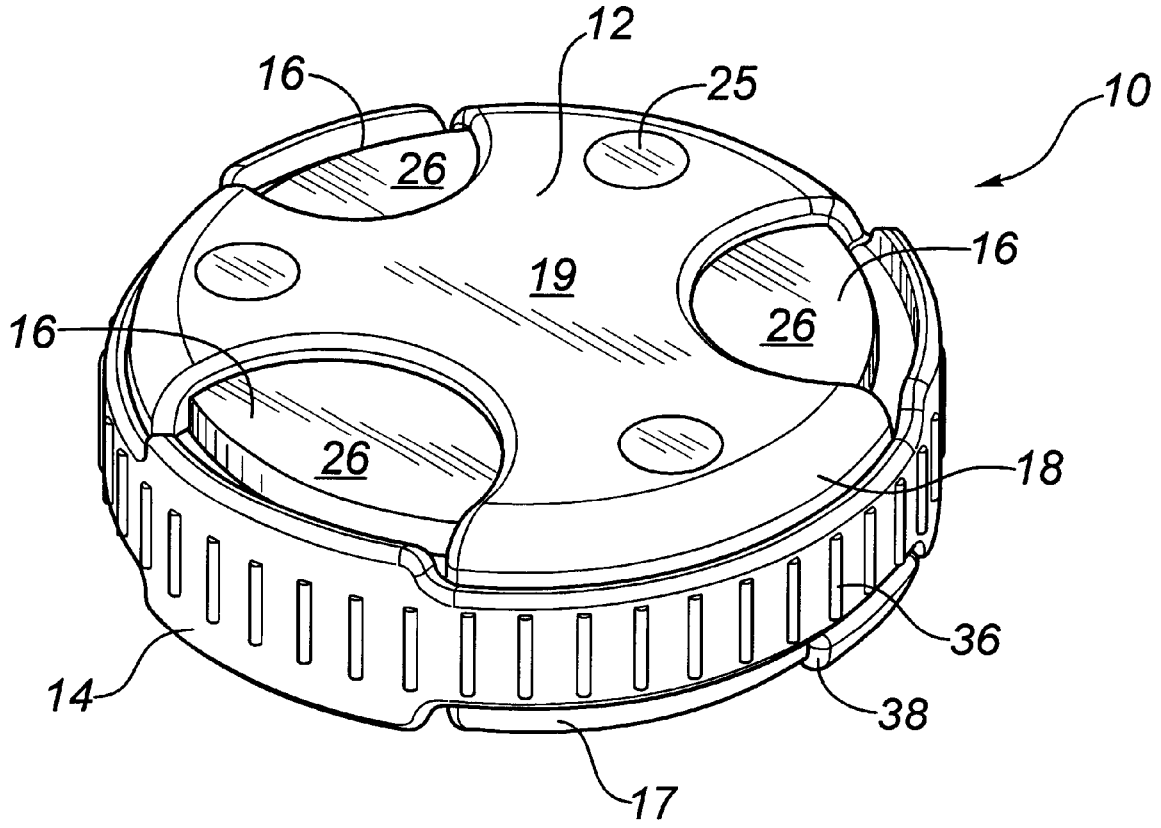
FIG. 1 is a perspective view of one embodiment of the invention.

The coin holder (10) of the present invention comprises a casing (12) and a locking band (14). In a preferred embodiment, the casing (12) defines three internal coin wells (16) and comprises an upper wall (19), a lower wall (21), and a peripheral wall (17). The coin holder (10) is preferably molded from a suitable plastic for ease of manufacturing, but any suitable material may be used.

Figure 2:
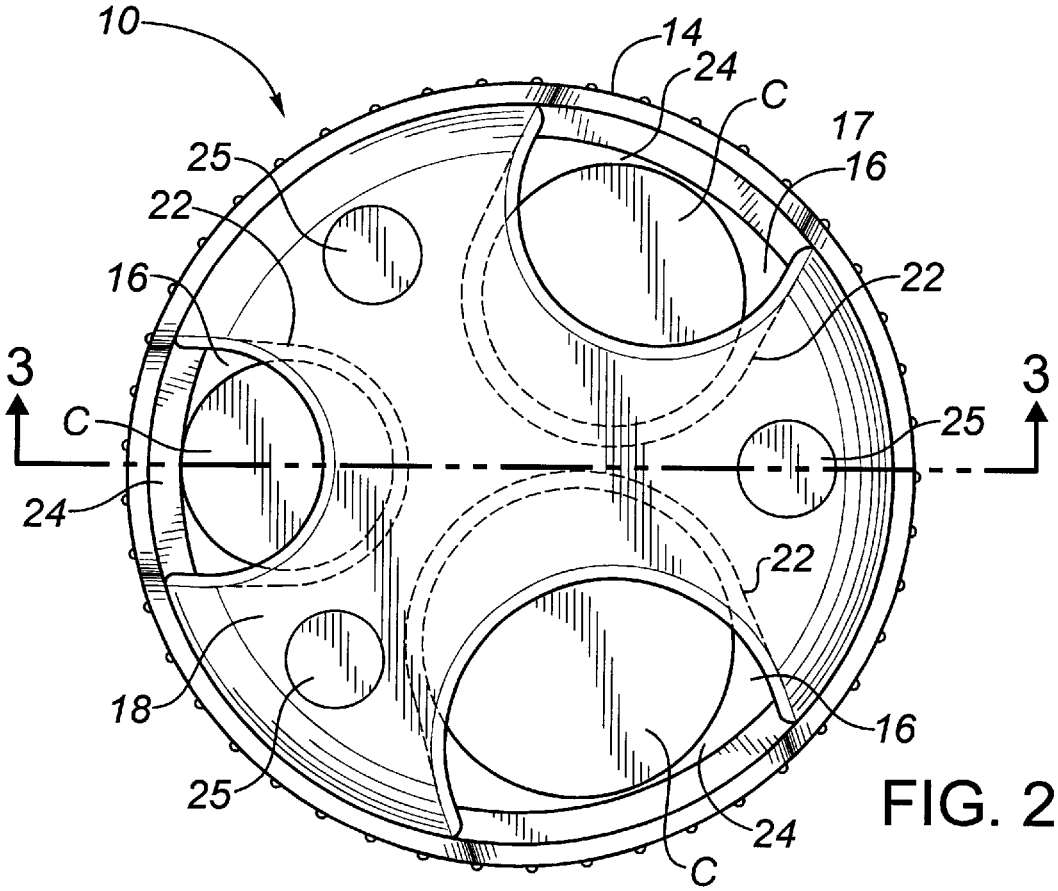
FIG. 2 is top plan view of the embodiment of FIG. 1.
Figure 3:
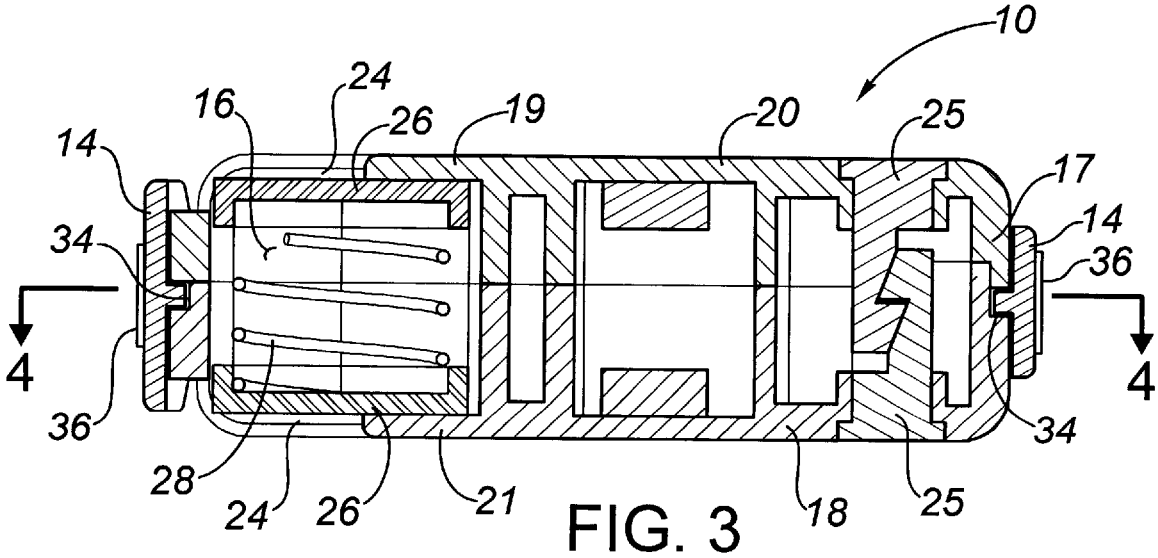
FIG. 3 is a vertical cross-sectional view of FIG. 2 along line 3—3.
Figure 4:
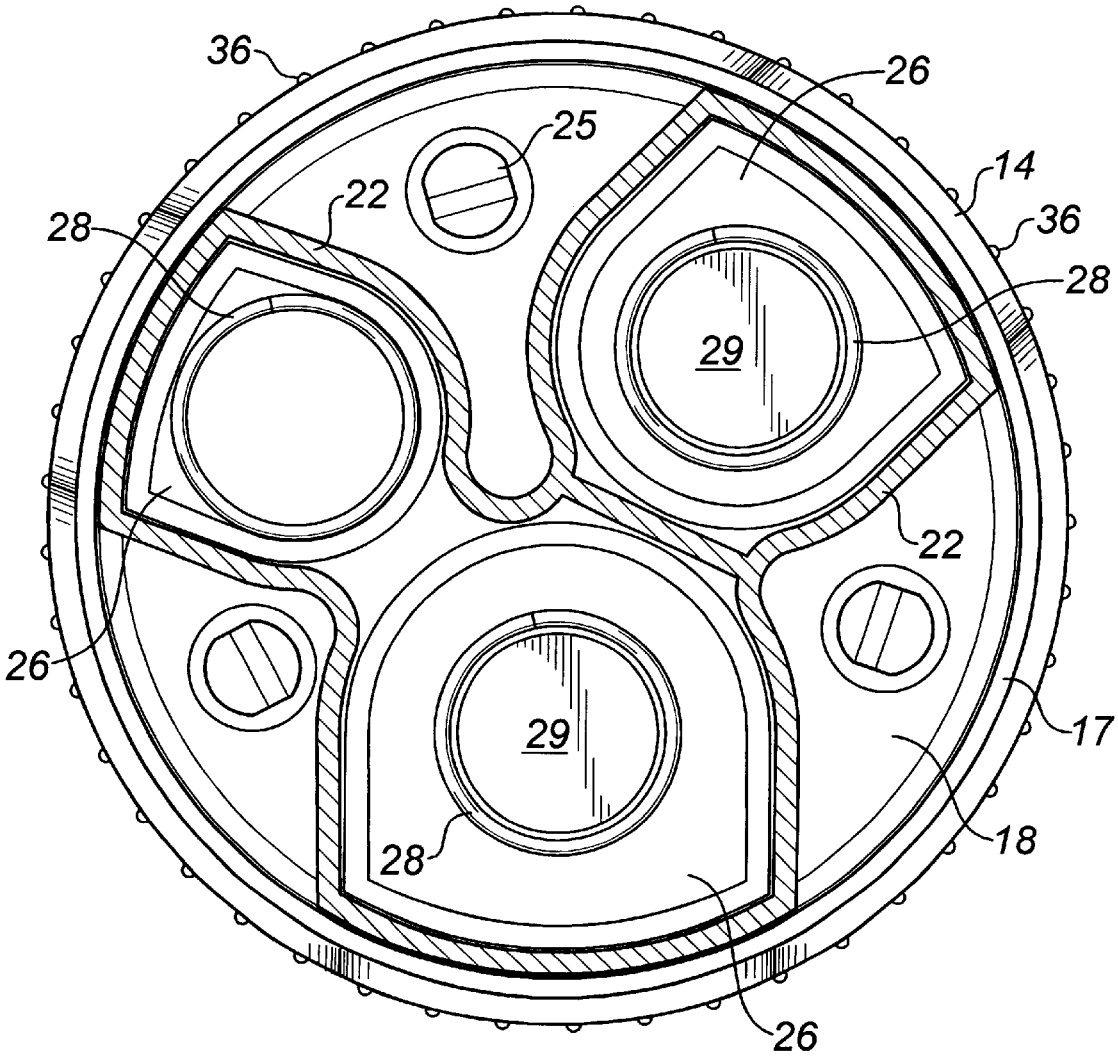
FIG. 4 is a horizontal cross-sectional view of FIG. 3 along line 4—4.
Figure 5:
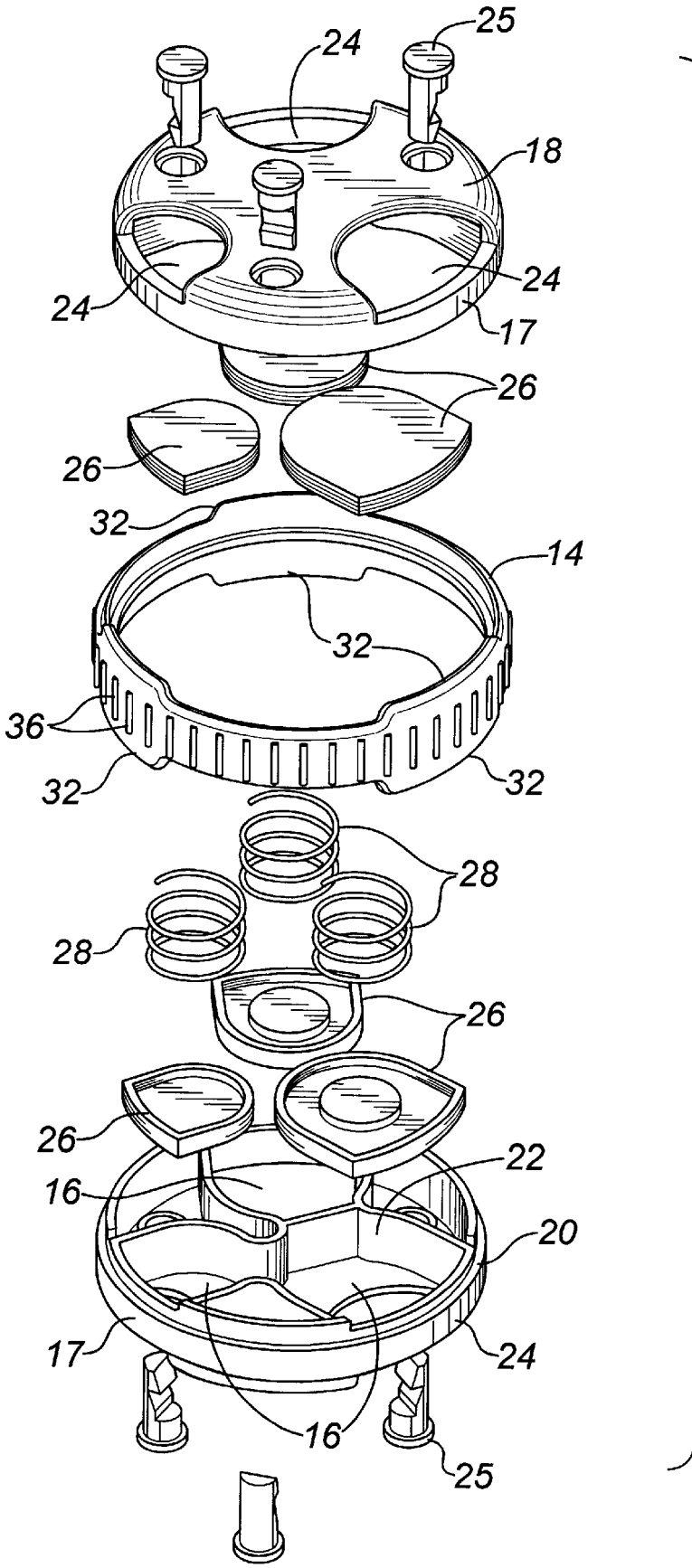
FIG. 5 is an exploded view of the embodiment illustrated in FIGS. 1 to 4.

In one embodiment, the casing (12) is assembled from two cup-shaped halves (18, 20) which mate together as is shown in FIGS. 3 and 5. Preferably the upper and lower halves of the casing (12) interlock so that they cannot rotate relative to one another when fitted together. Internally, the casing (12) includes walls (22) which define at least one and preferably three coin wells (16). The configuration of the walls (22) and the coin wells (16) is not essential to this invention. In FIG. 2, the walls (22) define three discrete coin wells (16). In FIG. 4, the walls (22) have a slightly different configuration. In a preferred embodiment, the coin wells (16) created by the walls (22) are each slightly different in size so the coin holder may accommodate coins of different sizes. In a preferred embodiment, each coin well (16) opens through both the upper casing (18) and the lower casing (20) and is divided into an upper coin well and a lower coin well as described below, so that six different coin wells are provided.

In a preferred embodiment, the openings (24) also vary slightly in size so that six different sized openings are provided to accommodate six different sized coins. Each opening (24) is preferably approximately semi-circular as is shown in FIG. 2 although different shaped openings may also be implemented. As may be seen in FIG. 2, the openings (24) overlap with an outer portion of the coin well (16) leaving an inner portion of the coin well covered by the casing (12). The openings open upward or downward through the casing (12) and as well open laterally through the casing peripheral wall (17). If the opening is sized appropriately, a coin (C) may be inserted into the coin well (16) only sliding the coin laterally into the coin well, between the casing (12) and the retaining disc (26) described further herein. As used herein, "lateral" or "laterally" refers to a direction which is radial to the casing, parallel to the upper and lower walls of the casing. As used herein, "vertically", "upward", "upper", "downward", "lower" refers to a direction which is perpendicular to a lateral line.

In one embodiment, the two halves of the casing are retained together by interlocking pins (25) which lock together as shown in FIGS. 3 and 5. Preferably, three sets of interlocking pins (25) are interspersed between the three coin wells. The ends of the pins (25) are shaped such that the pins may be interlocked by sliding the ends past each other and thereafter cannot be separated unless one pin is moved laterally from the other pin. The purpose of the pins (25) is to lock the two halves (18, 20) of the casing (12) together and to a limited extent, to prevent one half from rotating relative to the other half. Alternatively, the two halves (18, 20) may be glued or otherwise bonded together. One skilled in the art may conceive of numerous alternatives or variations to accomplish the same purpose.

Upper and lower discs (26) are disposed within each coin well (16) to divide the coin well into upper and lower sections and are urged apart by a coil spring (28). The underside of each disc may have means for engaging the coil spring so that the coil spring does not slide laterally. In the embodiment shown, the coil spring engaging means is a raised circular block (29) around which the coil spring is placed. In the embodiment shown in FIG. 4, the smallest disc (26) does not require a raised circular block as the spring (28) fits snugly within a raised perimeter of the disc (26).

The coins (C) are retained in the coin well (16) by the vertical pressure exerted by the spring (28). As coins are placed within the coin well, from either the upper opening (24) or the lower opening (24), the coil spring compresses and urges the disc (26) and coins against the casing. The coins are prevented from sliding out laterally by a locking ring band (14) which rotationally engages the casing (12). The band (14) has projections (32) formed by an enlarged width in the areas where it coincides with coin openings (24). The projections (32) close the lateral portion of the coin opening (24) which opens through the peripheral wall (17) and thereby prevent the topmost coin in the coin well (16) from slipping out laterally. The band (14) may be rotated relative to the casing (12) so that the projections (32) do not cover the opening, allowing coins to be easily removed from the coin well (16) by sliding the coins out laterally by gripping the top surface of the coin exposed by the opening (24). The band (14) may engage the casing (12) by a tongue and groove (34) configuration as is shown in the cross-sectional view of FIG. 3. In order to facilitate assembly, the groove (34) may be formed between the upper and lower halves of the casing (12) as is also shown in FIG. 3.

In one embodiment, the band (14) has a textured surface to assist a user in gripping the band to rotate it. The texture may be a plurality of ridges (36) as is shown in the Figures. A stop (38) may be formed in the casing to prevent over rotation of the band in either direction. The band should preferably frictionally engage the casing so that the band may not unintentionally freely rotate between its open and closed positions.

As will be apparent to those skilled in the art, various modifications, adaptations and variations of the foregoing specific disclosure can be made without departing from the scope of the invention claimed herein.

What is claimed is:

1. A coin holding apparatus comprising:

(a) a disk shaped casing comprising an upper wall, a lower wall and a peripheral wall, wherein said casing defines at least one internal coin well for receiving a substantially circular coin of a certain diameter and thickness, said coin well having an opening which:

i. opens through a gap in the peripheral wall wherein the width of said gap is larger than the diameter of the coin and the height of said gap is larger than the thickness of the coin; and ii. opens through the upper wall such that an outer portion of the coin well is open through the opening and an inner portion of the coin well is covered by the casing;

(b) a band which encircles and rotationally engages the casing peripheral wall and which comprises at least one projection along a portion of the band wherein said band is rotatable between a closed position where the at least one projection blocks the peripheral surface gap of the at least one opening thereby blocking lateral removal of a coin from the coin well and an open position where the at least one projection does not block the peripheral surface gap; and (c) a retaining disk which is positioned within the at least one coin well and which is moveable vertically within the coin well; and (d) biasing means for urging the disk towards the upper wall of the casing.

2. The coin holding apparatus of claim 1 wherein the at least one coin well has two coin openings wherein the first opening opens through the upper wall and the second opening opens through the lower wall and further comprising a second retaining disk which is positioned within the at least one coin well and which is moveable vertically within the coin well and biasing means for urging the first disk towards the upper surface and the second disk towards the lower surface.

3. The coin holding apparatus of claim 1 wherein there are at least two coin wells of different sizes to accommodate coins of different diameters.

4. The coin holding apparatus of claim 2 wherein there are at least two coin wells, each having a first opening and a second opening.

5. The coin holding apparatus of claim 4 wherein there are three coin wells, each having a first opening and a second opening.

6. The coin holding apparatus of claim 1 wherein the casing comprises an upper wall casing half and a lower wall casing half which mate together.

7. The coin holding apparatus of claim 6 wherein the two casing halves are bonded together.

8. The coin holding apparatus of claim 6 wherein the two casing halves are held together by at least one pair of interlocking pins, one of which is inserted through the upper casing wall and one of which is inserted through the lower casing wall.

9. The coin holding apparatus of claim 2 wherein the openings are semi-circular.

10. The coin holding apparatus of claim 1 wherein the biasing means is a spring.

11. The coin holding apparatus of claim 2 wherein the biasing means is a spring.

12. A coin holding apparatus comprising:

(a) a circular casing having a top side and a bottom side and internal walls defining three coin wells, each coin well having a first opening through the top side and a second opening through the bottom side, wherein each opening is sized to permit a coin to be slid into and out of the coin well laterally but not vertically;

(b) a first disc and a second disc each disposed in each coin well and each moveable vertically within each coin well;

(c) biasing means for spreading each first and second disc pair apart within each coin well;

(d) a band which rotationally engages the circumference of the casing, wherein said band defines six projections, each projection corresponding to an opening, and wherein said band is moveable between a closed position where each projection blocks its corresponding opening to prevent lateral movement of a coin positioned within the coin well and an open position where the projection does not block its corresponding opening.

* * * * *